US006481607B1

(12) United States Patent
Van Cott

(10) Patent No.: US 6,481,607 B1
(45) Date of Patent: Nov. 19, 2002

(54) DISPENSER FOR ROLL OF TAPE

(75) Inventor: Tanya H. Van Cott, New York, NY (US)

(73) Assignee: Traffic Works Inc., Huntington Park, CA (US)

( * ) Notice: Subject to any disclaimer, the term of this patent is extended or adjusted under 35 U.S.C. 154(b) by 0 days.

(21) Appl. No.: 09/571,416

(22) Filed: May 15, 2000

(51) Int. Cl.[7] ..... B26F 3/02; B65D 85/672

(52) U.S. Cl. ..... 225/46; 225/48; 225/77; 242/588.6; 242/598.6

(58) Field of Search ..... 225/46, 47, 48, 225/49, 39, 77, 66; 206/411, 398, 396; 242/588.4, 588.6, 598.6; D19/69

(56) References Cited

U.S. PATENT DOCUMENTS

| | | | | | |
|---|---|---|---|---|---|
| 876,866 | A | * | 1/1908 | Downing et al. | 206/39 |
| 1,892,544 | A | * | 12/1932 | Wanders | 192/13 R |
| 2,295,477 | A | | 9/1942 | Jackson | |
| 2,295,679 | A | | 9/1942 | Montbach | |
| 2,309,396 | A | * | 1/1943 | Jackson | 225/26 |
| 2,414,333 | A | * | 1/1947 | Schieman | 225/45 |
| 2,494,106 | A | * | 1/1950 | Rengo | 225/38 |
| 2,640,657 | A | * | 6/1953 | Guyer | 225/25 |
| 2,664,252 | A | * | 12/1953 | Glew | 225/66 |
| 2,710,152 | A | * | 6/1955 | Jones | 225/25 |
| 2,834,457 | A | * | 5/1958 | Dunning | 225/77 |
| 2,921,674 | A | * | 1/1960 | Ryder | 242/588.4 |
| 2,992,727 | A | * | 7/1961 | Zeitter | 242/588.4 |
| 3,000,494 | A | * | 9/1961 | Monroe | 206/397 |
| 3,013,653 | A | * | 12/1961 | Hedin | 242/588.4 |
| 3,014,578 | A | * | 12/1961 | Tolaas | 242/588.4 |
| 3,016,174 | A | * | 1/1962 | Perkins | 225/47 |
| 3,102,671 | A | | 9/1963 | Gershen | |
| 3,106,288 | A | * | 10/1963 | Bolding | 206/397 |
| 3,401,792 | A | * | 9/1968 | Tolaas | 206/396 |
| 3,448,852 | A | * | 6/1969 | Dunning | 242/588.4 |
| 3,587,840 | A | * | 6/1971 | Hultberg | 206/395 |
| 3,743,151 | A | | 7/1973 | Malcolm | |
| 3,815,801 | A | | 6/1974 | Perrin | |
| 3,972,459 | A | | 8/1976 | Cooper | |
| 4,060,444 | A | | 11/1977 | Schweig, Jr. et al. | |
| 4,140,218 | A | * | 2/1979 | Forte | 206/303 |
| 4,401,248 | A | | 8/1983 | Helms | |
| 4,700,835 | A | | 10/1987 | Rognsvoog, Jr. | |
| 4,898,312 | A | * | 2/1990 | Hwang | 225/26 |
| 5,358,113 | A | | 10/1994 | Hellenbrand | |
| 5,642,866 | A | * | 7/1997 | Nieding | 206/395 |
| 5,735,400 | A | | 4/1998 | Packard | |
| 5,950,959 | A | | 9/1999 | Milliorn | |
| 6,293,452 | B1 | * | 9/2001 | Mandar | 225/39 |

* cited by examiner

*Primary Examiner*—Allan N. Shoap
*Assistant Examiner*—Stephen Choi
(74) *Attorney, Agent, or Firm*—Liniak, Berenato & White

(57) ABSTRACT

A dispenser for a roll of tape that is suitable for dispensing material such as transparent pressure-sensitive adhesive, and method for making thereof are disclosed. The dispenser includes a single-piece housing comprising a first side wall and a second side wall extended from a central wall substantially parallel to each other. Each of the side walls is provided with roll mounting flaps cut out of the side walls opposite to each other and folded inwardly therefrom. The mounting flaps are axially aligned with each other and are adapted for rotatably supporting the tape roll within the frame. The housing is made of any appropriate stiff, but foldable material, such as a sheet of plastic or metal. The two side walls of the housing are retained in a substantially parallel position by a retaining member extending between the side walls within the core of the tape roll. A serrated cutting edge may be provided on an outer edge of the central wall.

10 Claims, 11 Drawing Sheets

DISPENSER FOR ROLL OF TAPE

BACKGROUND OF THE INVENTION

1. Field of the Invention

The present invention relates generally to devices for dispensing tape, and more particularly to a dispenser for a roll of adhesive tape especially of the type known as transparent pressure-sensitive adhesive tape sometimes referred to as "Scotch" tape and commonly used as a mending tape for torn documents and the like and for other purposes.

2. Description of the Prior Art

FIGS. 1 and 2 illustrate a typical prior art roll of tape 1. The roll 1 usually has a length of a tape 2 including a leading end portion 4, wound about a core 8. The core 8 has an inner diameter ID. The length of tape 2 includes a backing 3 with a pressure-sensitive adhesive coated on at least a portion of usually one side of the backing 3. The tape roll includes a pair of sides 5 and 6, a width W and an outer peripheral surface 7 defining an outer diameter D.

In many applications, the tape 1 includes a number of items in the roll wherein each item is separated from the next item by a row of separations. Perforated strips of postage stamps sold by the United States Postal Service in the form of rolls of stamps, are an exemplar of such items. FIG. 3 illustrates a conventional roll 1' of postage stamps in which the individual stamps 2' are separated by substantially parallel rows of spaced apart perforations 4'. Numeral 2" indicates an outermost end tape.

A number of various dispensers for tape rolls are known in the prior art. Examples of such dispensers are disclosed in U.S. Pat. No. 4,401,248 (Helms), U.S. Pat. No. 4,060,444 (Schweig), U.S. Pat. No. 3,972,459 (Cooper), U.S. Pat. No. 3,815,801 (Perrin), U.S. Pat. No. 3,743,151 (Malcolm), U.S. Pat. No. 2,295,679 (Montbach) and U.S. Pat. No. 2,295,477 (Jackson).

SUMMARY OF THE INVENTION

The present invention provides a dispenser for a roll of tape that is suitable for dispensing material such as transparent pressure-sensitive adhesive, and method for making thereof. The dispenser in accordance with the present invention is inexpensive to produce and easy to assemble.

In one aspect, the present invention discloses an improved dispenser for a roll of tape. The roll of tape has a length of tape, a pair of sides, a width, an outer peripheral surface defining an outer diameter, and a core defining an inner diameter. While the dispenser is particularly suitable for a roll of pressure-sensitive adhesive tape, the dispenser may also be utilized with other types of tapes.

The dispenser includes a single-piece housing comprising a first side wall and a second side wall placed opposite and arranged substantially parallel to each other. Each side walls has an outer periphery that may have any desired contour, such as circular, square, elliptical, gear-like, etc. Likewise, the outer periphery may be designed to appear as a product or company logo, trademark, name, etc. The housing also includes a central wall extending between the outer peripheries the first and second side walls. The central wall has a pair of outer edges.

The housing is constructed from an inexpensive plastic material, such as polystyrene, polyethylene, polypropylene and polycarbonate. The dispenser housing is a single-piece part which is inexpensive to produce and easy to assemble.

Each of the side walls comprises roll mounting flaps partially cut out of the side wall and folded inwardly therefrom toward the opposite wall.

In order to retain the side walls substantially parallel to each other, a side wall retaining member is employed. The retaining member extends between the side walls within the roll core.

Furthermore, one of the outer edges of the central wall is provided with a tape cutting member, preferably having a serrated cutting edge along which a portion of the tape can be separated from the roll of tape. Alternatively, the serrated cutting edge may be formed on one of the outer edges of the central wall of the housing integrally therewith.

In another aspect, the present invention comprises a method making a dispenser for a roll of tape having a pair of sides and edges, a width, an outer peripheral surface defining an outer diameter, and a core defining an inner diameter. The method comprises the steps of: a) providing a sheet of stiff and foldable material; b) cutting out from the sheet a flat blank including first and second side walls interconnected by a central wall, the central wall having an axis of symmetry; c) making partial cutouts on the side walls, defining roll supporting flaps, so that the cutouts on the side walls are symmetrical relative to the axis of symmetry; d) cutting out a hole on each of the side walls so that the holes are symmetrical relative to the axis of symmetry; e) folding said flaps inwardly from the side walls forming a support for rotatably supporting the core of the tape roll; f) placing the roll core about the folded flaps formed on the first side wall; g) folding both side walls substantially perpendicular to the central wall while inserting the folded flaps formed on the second side wall into the roll core; h) providing a side wall retaining member extending within the core trough the holes in the side walls; and i) providing the central wall with a tape cutting member, preferably having a serrated cutting edge. Alternatively, the serrated cutting edge may be formed on one of the outer edges of the central wall of the housing blank integrally therewith.

The tape dispenser in accordance with the present invention could be manufactured very inexpensively from low-price materials. Thus, the tape dispenser of the present invention is ideal as a promotional product to give away, especially when it is formed in the shape of a Corporate Logo or an entertaining figure.

BRIEF DESCRIPTION OF THE DRAWINGS

Other objects and advantages of the invention will become apparent from a study of the following specification when viewed in light of the accompanying drawings, wherein.

DETAILED DESCRIPTION

Figure 1:
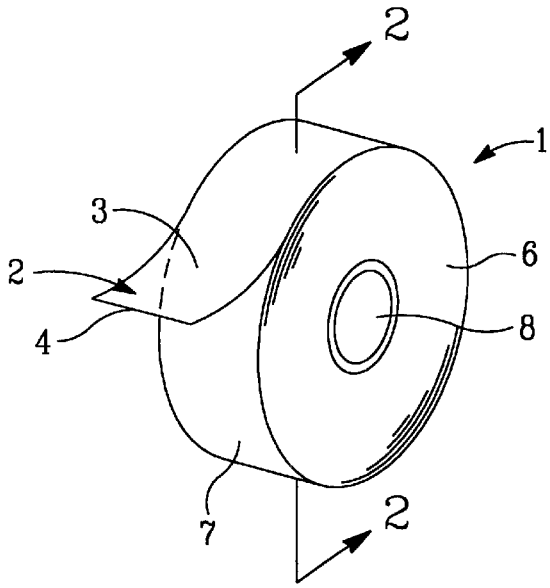
Fig. 1 Prior Art
FIG. 1 is a perspective view of a prior art roll of tape.
Figure 2:
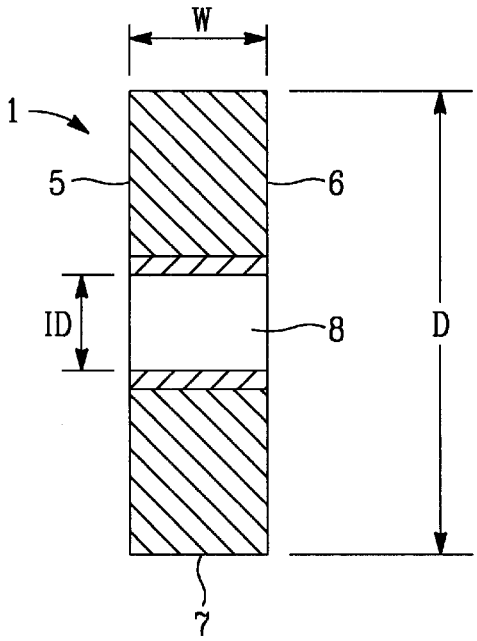
Fig. 2 Prior Art
FIG. 2 is a sectional view of the roll of tape of FIG. 1 taken along lines 2—2.
Figure 3:
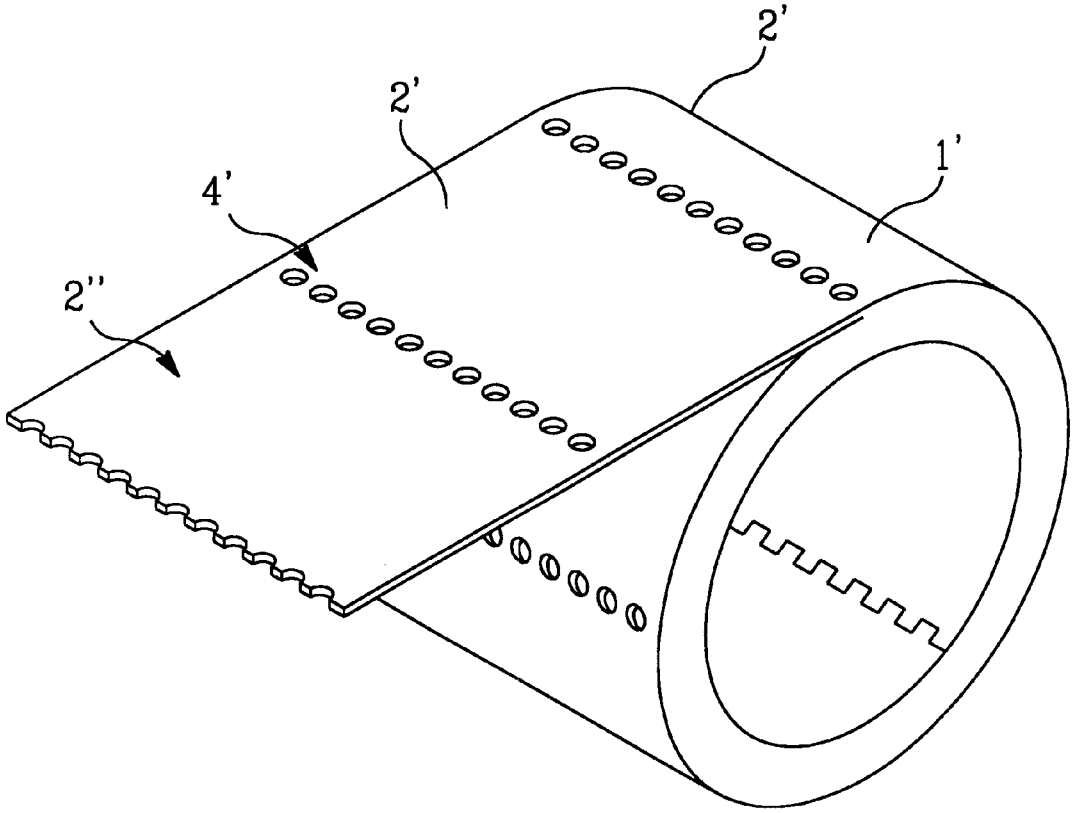
Fig. 3 Prior Art
FIG. 3 is a perspective view of a prior art roll of postage stamps.
Figure 4:
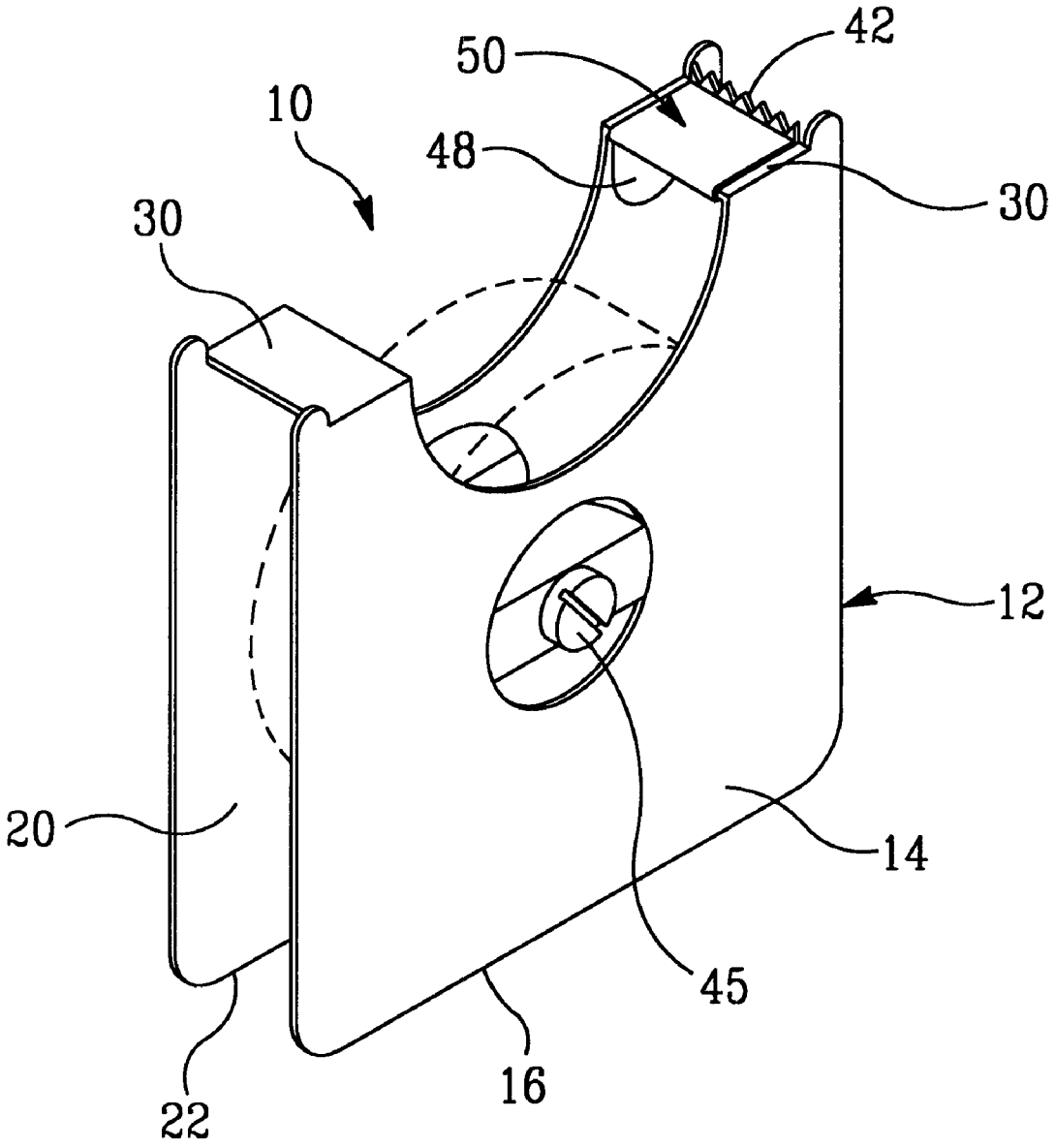
FIG. 4 is a perspective view of a dispenser for a roll of tape according to the present invention, with dashed lines illustrating the roll of tape placed in the dispenser.
Figure 5:
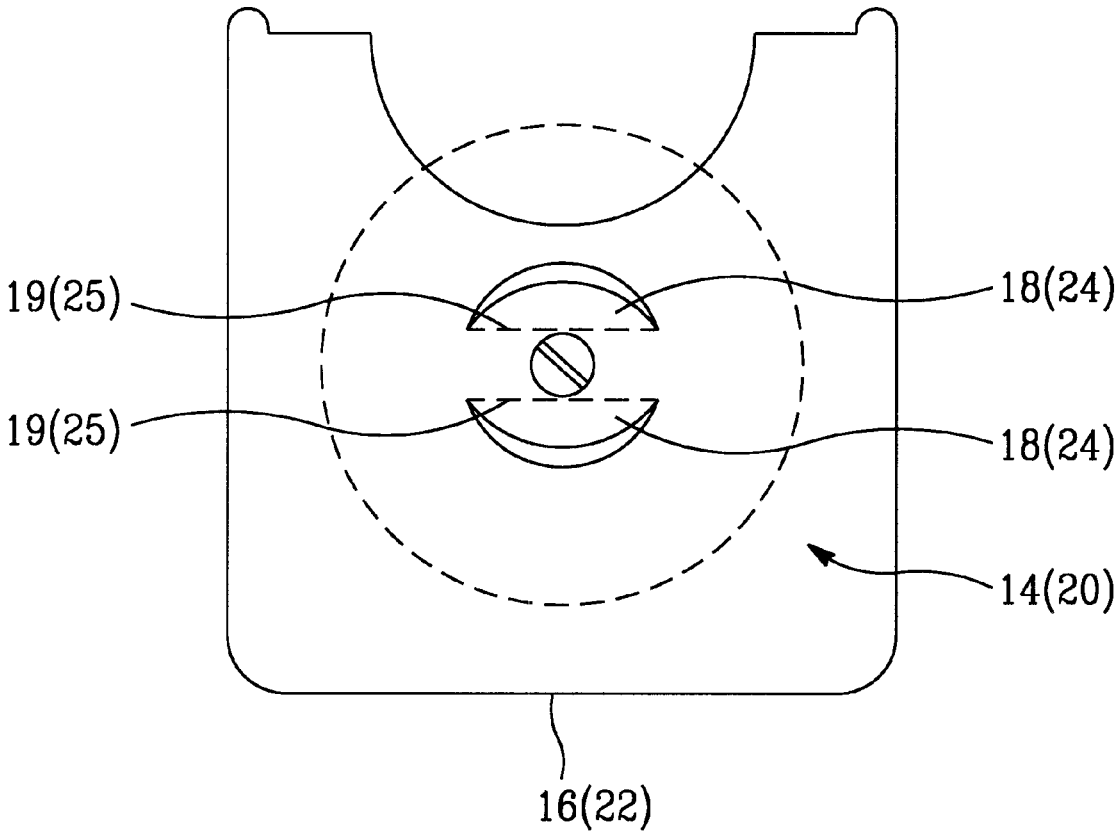
FIG. 5 is a side view of the dispenser of FIG. 3 which illustrates the position of the roll of tape with dashed lines.

Referring now to the illustrations for a better understanding of the invention, it will be seen that this invention is a dispenser indicated generally by reference numeral 10, adapted to hold the roll 1 of relatively narrow material, such as cellophane tape 2, whereby the material can be dispensed from the roll 1. The dispenser 10, illustrated in FIGS. 4–7, includes a frame or housing indicated generally by reference numeral 12. The housing 12 comprises a first side wall 14 and a second side wall 20 placed opposite and arranged substantially parallel to each other. The first side wall 14 has an outer periphery 16, and the second side wall 20 has an outer periphery 22. The outer peripheries 16 and 22 may have any desired contour, such as circular, square, elliptical, gear-like, etc. Likewise, the outer periphery may be designed to appear as a product or company logo, trademark, name, shape of an animal or insect, etc.

The housing 12 also includes a central wall 30 extending between the outer peripheries 16 and 22 of the first and second side walls 14 and 20 respectively. The central wall 30 has a pair of outer edges 32.

Each of the side walls 14 and 20 comprises roll mounting flaps. The first side wall 14 has a pair of roll mounting flaps 18 partially cut out of the first side wall 14 and folded inwardly therefrom toward the second side wall 20. Correspondingly, the second side wall 20 has a pair of roll mounting flaps 24 partially cut out of the second side wall 20 and folded inwardly therefrom toward the first side wall 14. As better illustrated in FIGS. 5 and 6, the flaps 18 and 24 are disposed within the core 8 of the tape roll 1 and adapted to rotatably support the tape roll within the housing 12.

Figure 6:
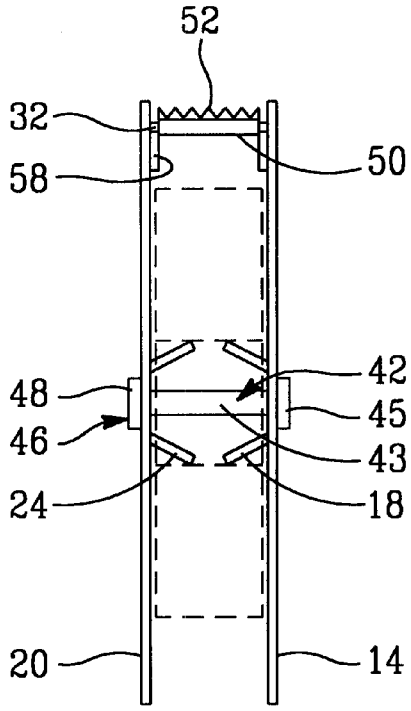
FIG. 6 is a front view of the dispenser of FIG. 3 which illustrates the position of the roll of tape with dashed lines.
Figure 7:
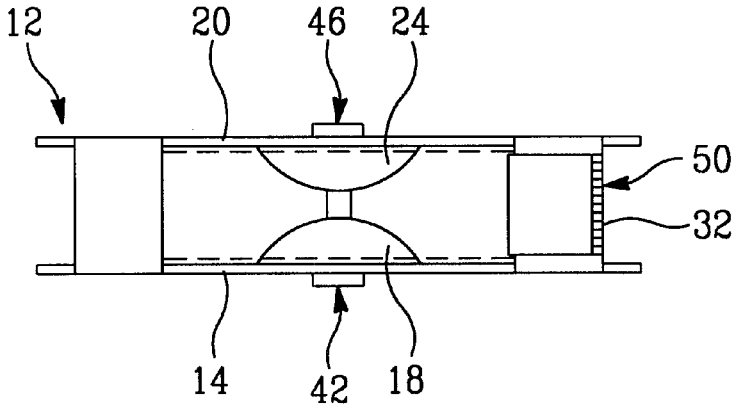
FIG. 7 is a top view of the dispenser of FIG. 3 which illustrates the position of the roll of tape with dashed lines.
Figure 8:
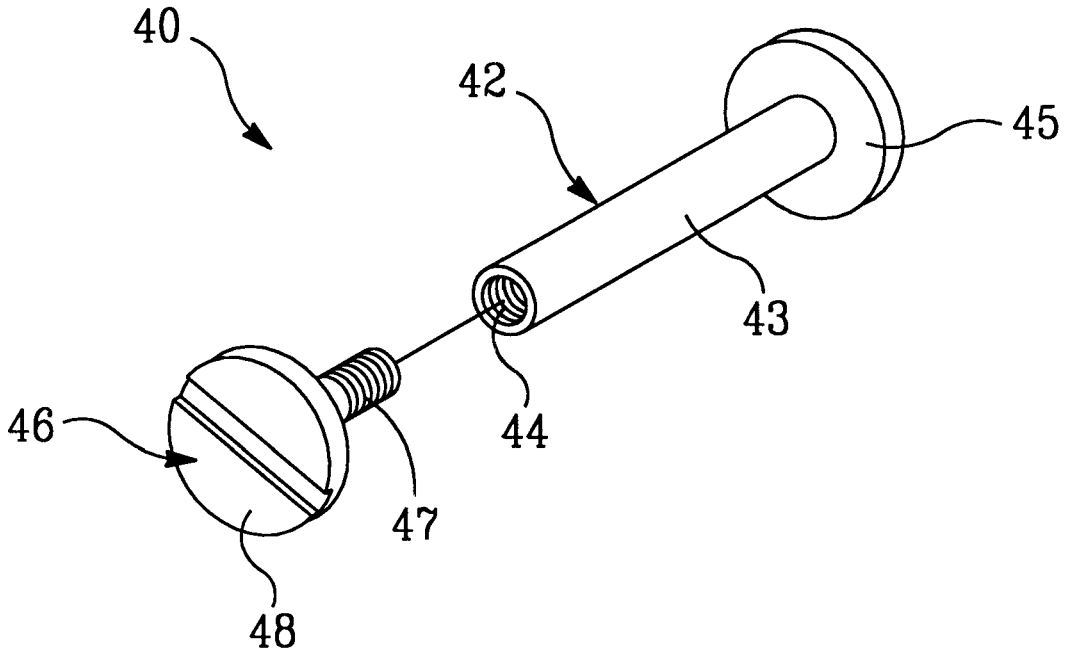
FIG. 8 is an exploded perspective view of a side wall retainer member.

In order to retain the side walls 14 and 20 substantially parallel to each other, a side wall retaining member 40 is employed. In the preferred embodiment, illustrated in detail in FIG. 8, the retaining member 40 includes an elongated pin 42 and an end member 46 removably secured to the pin 42. The pin member has an elongated body 43 provided with internal threads 44, and a head 45. The end member 46 has an externally threaded body 47 and a head 48. The threaded body 47 of the end member 46 is adapted to be threaded into the body 43 of the pin 42. The head 45 engages an outside surface of the first side wall 14 and the pin body 43 extends through a hole 17 in the first wall 14, between the first and second side walls within the roll core 8. As shown in FIGS. 6 and 7, the head 48 of the end member 46 engages an outside surface of the first side wall 20 and threadedly secured to the pin 42 extending through a hole 23 in the second wall 20. Thus, the member 40 retains the side walls 14 and 20 substantially parallel to each other and positions mounting flaps 18 and 24 within the roll core 8.

It would be appreciated that the side wall retaining member 40 may comprise a rivet, bolt and nut assembly or any other appropriate fastening device well known to those skilled in the art, adapted to extend within the roll core 8 and retain the side walls 14 and 20 of the housing 12.

As illustrated in the FIGS. 4–7, one of the outer edges 32 of the central wall 30 is provided with a tape cutting member 50 preferably having a serrated cutting edge 52 along which a portion of the tape can be separated from the roll of tape 1. The cutting member 50 may be made of any appropriate material, such as metal or hard plastic.

Figure 9:
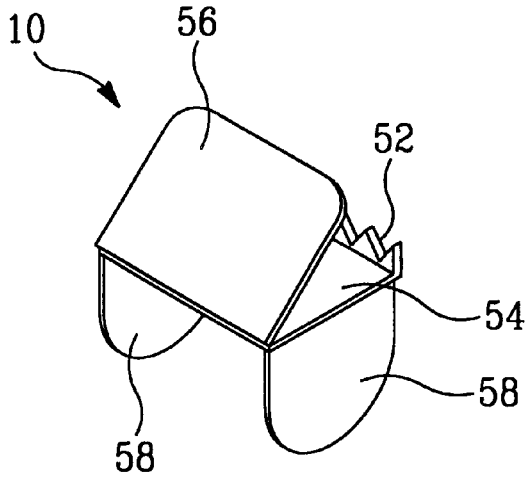
FIG. 9 is a perspective view of a tape cutting member.
Figure 10:
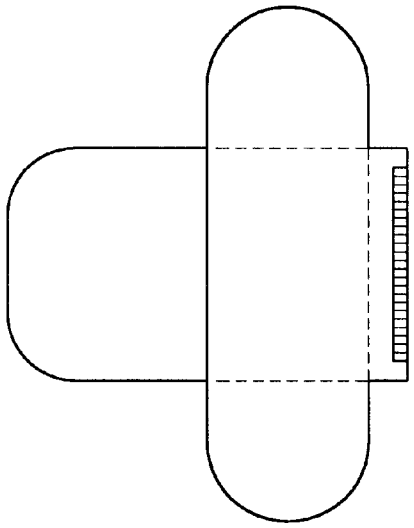
FIG. 10 is a top view of a single-piece blank used to construct the tape cutting member of FIG. 9.

Preferred embodiment of the tape cutting member 50 is illustrated in detail in FIG. 9. It includes a support surface 54, retaining flap 56, and a pair of opposite side flaps 58. Preferably, the tape cutting member 50 is formed of a single die cut piece of bendable flat metal sheet, illustrated in FIG. 10. The tape cutting member 50 is secured to the housing 12 by clamping the central wall 30 between the support surface 54 and the retaining flap 56. The side flaps 58 are adapted to improve structural integrity of the housing 12 and reduce twisting of the tape dispenser during the cutting operation when pressure is applied to the cutting edge 52.

Alternatively, the serrated cutting edge 52 may be formed on one of the outer edges 32 of the central wall 30 integrally therewith.

Figure 11:
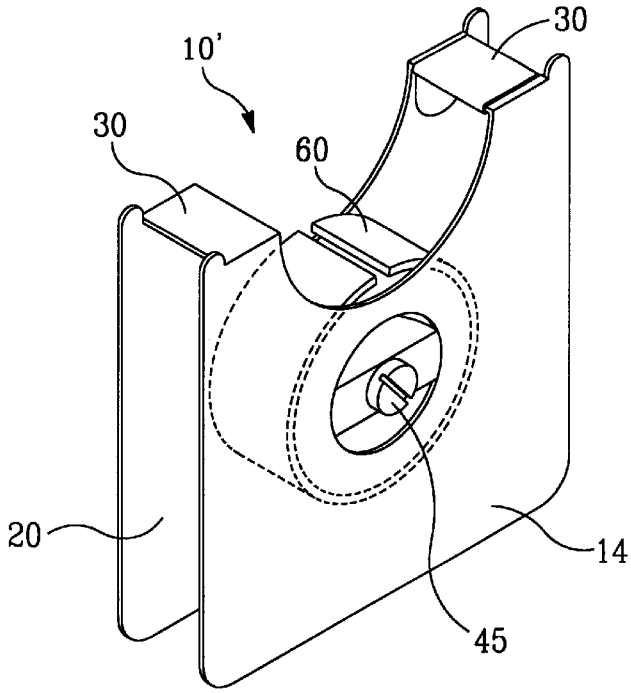
FIGS. 11 is a perspective view of a dispenser for a roll postage stamps according to the present invention.
Figure 12:
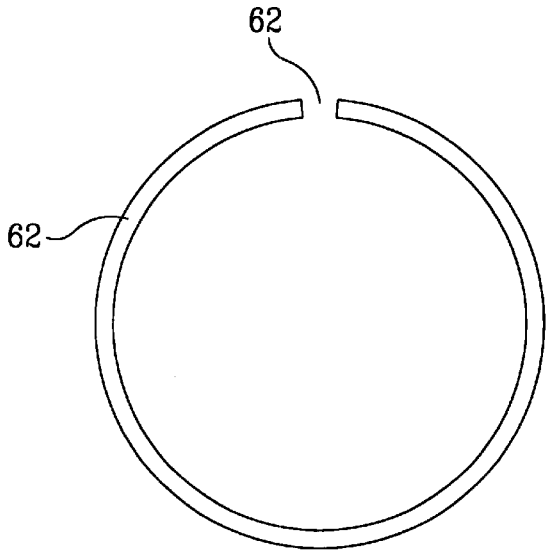
FIG. 12 is a side view of a roll retaining ring.

FIG. 11 illustrates a second exemplary embodiment of the present invention that discloses a dispenser of the roll of postage stamps, indicated generally by a reference numeral 10'. Components that are unchanged from the first exemplary embodiment depicted in FIGS. 4–10 are labeled with the same reference numerals. The dispenser 10' of the roll of postage stamps, is substantially similar to the roll tape dispenser 10 of the first embodiment, however, the stamp roll dispenser 10' does not include a tape cutting member. Instead, in order to facilitate dispensing of the postage stamps, the dispenser 10' includes a roll-retaining ring 60 illustrated in detail in FIG. 12. The roll-retaining ring 60 is provided with an elongated tape-dispensing slot 62. Preferably, the roll-retaining ring 60 is cut from an extruded plastic tube. Conventionally, the stamp rolls are sold in the form of a relatively tightly wound rolls and the outermost end stamp 2" is adhered to the roll by an adhesive strip. The user cuts the adhesive strip, then places the roll 1' in the roll-retaining ring 60 and inserts the outermost end stamp 2" into the tape-dispensing slot 62. The roll-retaining ring 60 is, therefore, adapted to receive the roll of postage stamps 1', while the outermost end stamps are dispensed through the tape-dispensing slot 62 by tearing one or more stamps as needed along lines of perforations 4' between them.

It would be appreciated that other labels are also packaged in strips that are formed into rolls from which they may be dispensed one or more at a time utilizing the tape dispenser 10' of the present invention.

The method for making the tape dispenser 10 comprises the following step. The housing 12 is formed from a single-piece blank B cut out from a cardboard, a sheet of metal, or inexpensive plastic material, or any other appropriate relatively stiff and foldable material. The blank B is preferably cut from the plastic material selected from the group consisting of polystyrene, polyethylene, polypropylene and polycarbonate. The blank B, illustrated in detail in FIG. 13, includes the first and second side walls 14 and 20, and the central wall 30. The central wall 30 has an axis of symmetry 11. The first side wall 14 has the outer periphery 16, and the second side wall 20 has the outer periphery 22. As it was noted above, the outer peripheries 16 and 22 may have any desired contour, such as circular, square, elliptical, gear-like, or they may be designed to appear as a product or company logo, trademark, name, shape of an animal or insect, etc. As an example, FIG. 14 illustrates the blank B having the side walls cut in the shape of a butterfly. It would be appreciated that any other ornamental designs of the side wall periphery are within the scope of the present invention.

Figure 13:
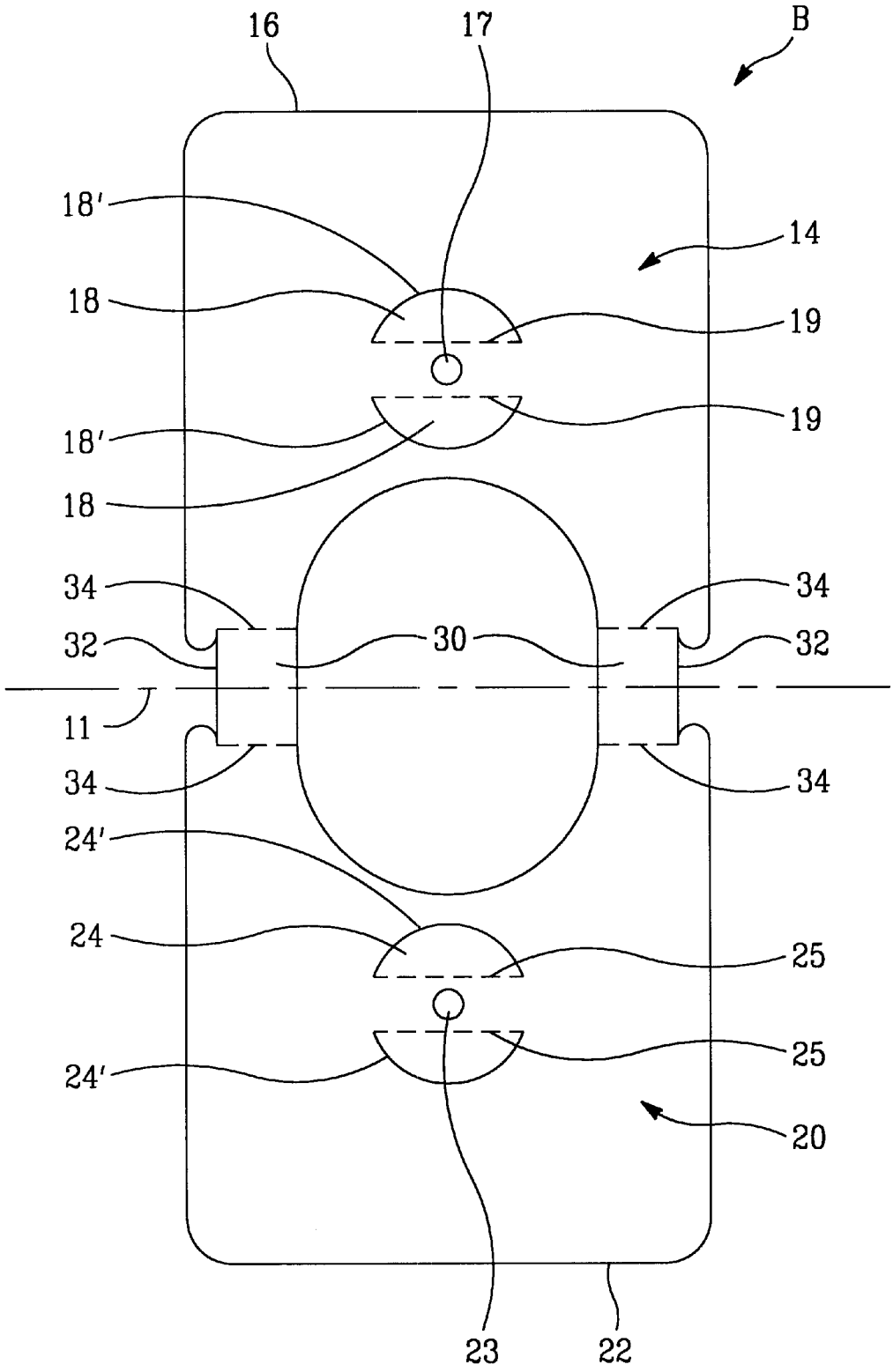
FIG. 13 is a top view of a single-piece blank used to construct a housing of the dispenser of FIG. 4.
Figure 14:
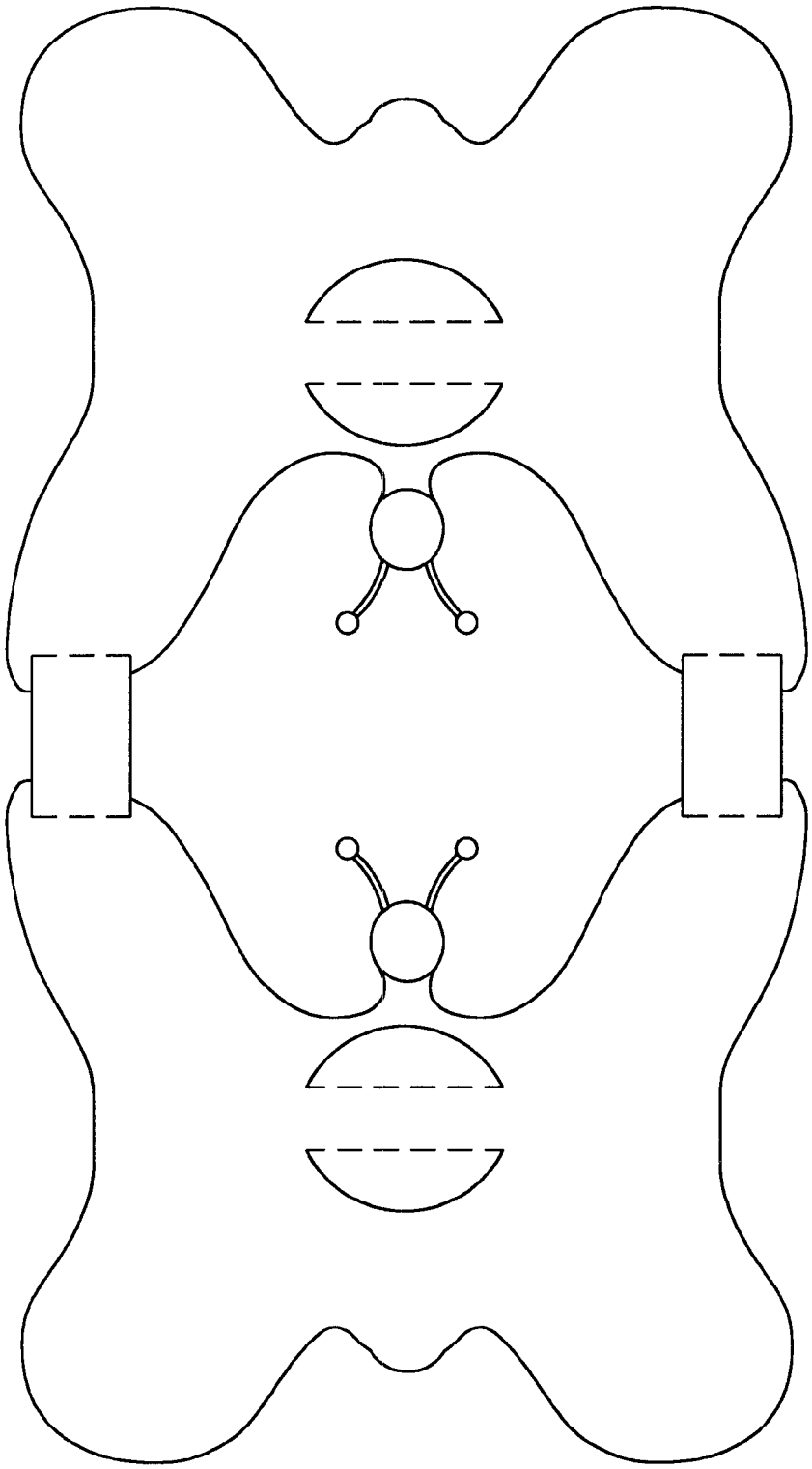
FIG. 14 is a top view of a single-piece blank used to construct a housing of the dispenser, wherein side walls of the housing are formed in the shape of a butterfly.
Figure 15:
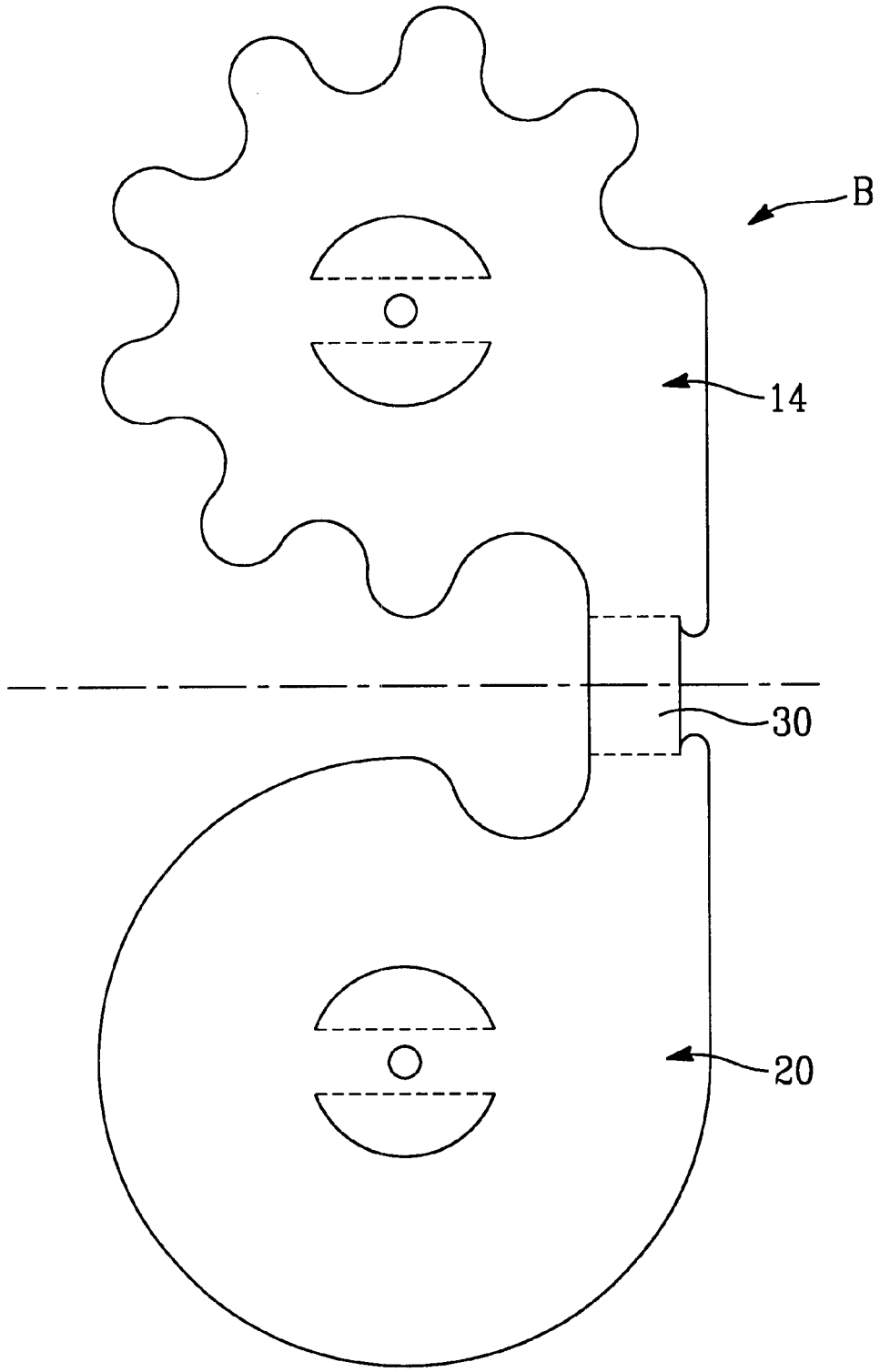
FIG. 15 is a top view of a single-piece blank used to construct a housing of the dispenser, having asymmetrical side walls.

Moreover, although the tape dispenser blanks illustrated in FIGS. 13 and 14, have symmetrical side walls 14 and 20, they may, alternatively, have different shapes. An example of such a tape dispenser blank B that has the asymmetrical side walls, is illustrated in FIG. 15.

Furthermore, crease lines 34 may be provided on the blank B to zone the blank B into the side walls 14, 20 and the central wall 30, and facilitate the process of folding of the side walls.

Partial cutouts 18' and 24', preferably arcuate in shape, are made on the first and second side walls defining the supporting flaps 18 and 24. The flaps 18 and 24 are symmetrical with respect to the axis 11. Preferably, crease lines 19 and 25 are provided on the corresponding side walls 14 and 20.

The holes 17 and 23 are punched out in the corresponding side walls 14 and 20 between the respective pair of flaps 18 and 24.

Next, the side walls 14 and 20 are folded along the crease lines relative to the central wall 30 so that the side walls are disposed opposite and substantially parallel to each other, thus forming the housing 12. Then, the flaps 18 and 24 are folded inwardly from the side walls 14 and 20 along the crease lines 19 and 25 respectively, thus forming a support for the roll core 8. After this, the tape roll 1 is placed within the housing 12 and the mounting flaps 18 and 24 are inserted into the core 8 for rotatably supporting thereof.

Subsequently, the side wall retaining member 40 is provided. In the preferred embodiment, the pin 42 is inserted into the hole 17 in the first wall 14 and extends to the second wall 20. Then, the end member 46 is inserted into the hole 23 so that the head 48 of the end member 46 engages the outside surface of the first side wall 20, and threadedly secured to the pin 42. Thus, the side walls 14 and 20 are retained substantially parallel to each other and the mounting flaps 18 and 24 are positioned within the roll core 8.

Finally, the central wall 30 of the housing 12 is provided with the tape-cutting member 50, preferably having a serrated cutting edge 42. Alternatively, the serrated cutting edge 52 may be formed on one of the outer edges 32 of the central wall 30 so that the tape cutting member 50 and the blank B are made of a single-piece material.

The method for making the dispenser of the roll of postage stamps 10' is substantially identical to one described hereinabove. However, it does not include the step of providing the tape-cutting member. Instead, the stamp roll dispenser 10' is provided with the roll retaining ring 60, as described above and illustrated in FIGS. 11 and 12.

Thus, it will be appreciated that the present invention presents a tape roll dispenser of very simple design and construction that is inexpensive to produce.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiment disclosed hereinabove was chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A dispenser for a roll of tape having a leading end portion, an outer peripheral surface defining an outer diameter and a roll core defining an inner diameter; said dispenser comprising:

a housing formed of a single-piece blank of stiff and foldable sheet of plastic material and including:

a central wall;

a first and second opposite side walls foldably joined to and extending from opposite end edges of said central wall, each of said side walls having an outer periphery and holes;

roll mounting members integrally formed on said side walls opposite to each other and extending inwardly therefrom, said members being axially aligned with each other, said members adapted for rotatably supporting said roll within said frame, said members and said side walls being made of one-piece material, each of said members comprising a pair of roll mounting flaps partially cut out of said side walls symmetrically peripherally spaced around said holes, and folded inwardly therefrom, each of said roll mounting flaps having an arcuate shape;

a tape cutting means provided on said center wall; and a side wall retaining means extending through said holes between said side walls within the core of the roll for positioning and retaining said side walls spaced and substantially parallel to each other, said side wall retaining means being removably secured to said side walls and including an elongated pin having an elongated body provided with internal threads and a head, end member an externally threaded body and a head threadedly secured to said pin so that said pin engaging said fir side wall between one pair of said flaps and said end member engaging said second side wall between another pair of said flaps.

2. The dispenser for a roll of tape as defined in claim 1, wherein said side wall retaining means being made of plastic.

3. The dispenser for a roll of tape as defined in claim 1, wherein said side wall retaining means being made of metal.

4. The dispenser for a roll of tape as defined in claim 1, wherein said tape cutting means being made of plastic material.

5. The dispenser for a roll of tape as defined in claim 1, wherein said tape cutting means being made of metal.

6. The dispenser for a roll of tape as defined in claim 1, wherein said tape cutting means including a serrated cutting edge.

7. The dispenser for a roll of tape as defined in claim 6, wherein said serrated cutting edge being integrally formed on said central wall.

8. The dispenser for a roll of tape as defined in claim 6, wherein said serrated cutting edge and said housing are made of one-piece material.

9. The dispenser for a roll of tape as defined in claim 1, further comprising a roll retaining ring provided with an elongated tape dispensing slot, wherein said roll is disposed within said retaining ring and said leading end portion of said tape is extending through said dispensing slot.

10. The dispenser for a roll of tape as defined in claim 1, wherein said outer periphery of said side walls having ornamental contour.

* * * * *